US005794475A

United States Patent [19]

Schuppler et al.

[11] Patent Number: 5,794,475

[45] Date of Patent: Aug. 18, 1998

[54] APPARATUS AND PROCESS FOR MANUFACTURING PROFILED BODIES

[75] Inventors: Helmut Schuppler, Eislingen; Wolfgang Moser, Salach, both of Germany

[73] Assignee: Schuler Pressen GmbH & Co., Germany

[21] Appl. No.: 705,497

[22] Filed: Aug. 29, 1996

[30] Foreign Application Priority Data

Aug. 30, 1995 [DE] Germany ..... 195 31 907.9

[51] Int. Cl.[6] ..... B21D 9/08

[52] U.S. Cl. ..... 72/213; 72/212

[58] Field of Search ..... 72/208, 210, 212, 72/213, 224, 75, 193

[56] References Cited

U.S. PATENT DOCUMENTS 4,320,644 3/1982 Fischer ..... 72/75

FOREIGN PATENT DOCUMENTS 281553 8/1990 Denmark .
0 006 137 1/1990 European Pat. Off. .
0 558 815 9/1993 European Pat. Off. .
2 482 483 11/1981 France .
24 39 957 3/1976 Germany .
31 27 392 4/1982 Germany .
2-37931 2/1990 Japan .

*Primary Examiner*—Lowell A. Larson
*Assistant Examiner*—Rodney Butler
*Attorney, Agent, or Firm*—Evenson, McKeown, Edwards & Lenahan, P.L.L.C.

[57] ABSTRACT

For shaping longitudinal grooves or comparable longitudinal structures into round housings or housings which are otherwise regularly shaped with respect to a longitudinal axis, a press is provided with a deforming tool whose top tool presses a workpiece through a corresponding roll arrangement of a bottom tool. The bottom tool has an opening which is coaxial to the top tool contains an axially displaceable cage provided with a group of rolls. The rolls are rotatably disposed in the cage and are supported on radially exterior abutments which are stationarily held in the bottom tool. The rolls are constructed as profile rolls and shape the desired longitudinal structures into the workpiece when it is moved through between the profile rolls. The resulting radial reaction forces are absorbed exclusively by the abutments and not by the cage. For supporting the longitudinal movement of the cage, a transmission is formed, for example, by gear wheels which are rotatably disposed on the cage. The gear wheels are supported radially on the outside on stationary toothed racks and radially on the inside on a workpiece-operated slide provided with toothed racks.

16 Claims, 6 Drawing Sheets

35a
24
19
26a
32a
35b
51h
26b
28b
35c
26c
17
35d
26d
47h
26e
35e
24
26f
53
47
26g
35g
35f
51

APPARATUS AND PROCESS FOR MANUFACTURING PROFILED BODIES

BACKGROUND AND SUMMARY OF THE INVENTION

The present invention relates to an apparatus and to a process for manufacturing particularly hollow profiled bodies.

Such profiled bodies are, for example, clutch disk carriers, toothed belt pulleys or similar workpieces with a basic cylindrical structure which have longitudinal indentations on their circumferential surface. It is frequently necessary to manufacture such workpieces with a high precision. For example, in the case of toothed belt pulleys, the precision and the surface quality of the grooving to be entered into the outer circumferential surface of the workpiece are particularly important. Pitch inaccuracies, steps or shoulders in the surface or other faults will most probably result in a premature belt wear when a pulley with such surface faults is used.

Workpieces of the above-mentioned type are also frequently mass produced articles which must not only be manufactured to be of a high quality but must also be produced in high piece numbers. This should, of course, be possible at low cost.

DE-OS 24 39 957 describes a process and arrangement for cold-rolling parallel profiles, such as tooth profiles, from a solid material. The arrangement has a device for clamping in a shaft provided with a tooth profile. This device is equipped for being axially displaceable in a controlled manner and for providing the shaft with a desired angular position. For rolling the tooth profiles, two profile rollers are provided which are arranged transversely with respect to the shaft and which each contain an eccentrically disposed profile roll. The profile rollers rotate in opposite directions in which case the eccentrically guided rolls will periodically engage with and deform the shaft in steps. In this known process, the grooves to be entered on the circumferential surface of the shaft are molded in successively and in steps which requires a longer time period for each shaft.

Furthermore, DE-31 27 392 A1 shows an arrangement for cold-rolling profiles, in which correspondingly profiled rollers are rolled off on the circumference of the rotating workpiece. For this purpose, the arrangement has two profiled rollers which are disposed in a frame and can be moved toward and away from one another by an adjusting device. The workpiece to be profiled is rotatably held between the rollers, with the axis of rotation of the workpiece being parallel to the axes of rotation of the profiled rollers. For producing the exterior profile, the profiled rollers are set into rotation in the same direction forming the desired profile on the workpiece.

This conventional arrangement and process are suitable for deforming massive workpieces. The occurring reaction forces which act upon the profiled rollers must be absorbed by their bearing which may cause a very massive construction. The deformation of hollow workpieces is not addressed in the aforementioned known manner.

It is an object of the present invention to provide an arrangement and a process for manufacturing profiles by way of which workpieces provided with a longitudinal profile can be manufactured economically and with a good surface quality.

This object has been achieved in accordance with the present invention by providing an arrangement having a top tool adapted to be fastened on a slide of the press movable against a tool receiving device and engageable with and disengageable from a workpiece, a bottom tool stationarily disposable with respect to the slide and having an opening into which the top tool is movable and with an axis coinciding with a moving direction of the top tool, a set of profile rolls arranged in the opening of the bottom tool and having outer circumferential surfaces in contact with abutments which bound the opening and support the profile rolls radially outwardly, the profile rolls being arranged with axes of rotation thereof in a circumferential direction of the opening, and a cage arranged in the opening at which the profile rolls are held in the circumferential direction and movable in the axial direction of the opening such that the profile rolls are caged to one another with respect to the axial direction of the opening.

Furthermore, the foregoing object has been achieved by a process which introducing a workpiece to be deformed in a restrictedly operated manner into an opening of a tool in which the profile rolls are held by a cage, the rolls being arranged to roll off in a moving direction of the workpiece, engaging the workpiece with circumferential sections of the profile rolls facing the workpiece, the profile rolls being supported on their respective diametrically opposite circumferential areas within the opening, and pressing the workpiece farther into the opening, the profile rolls on one side rolling off on the workpiece and on another side on corresponding abutments and deforming the workpiece in an exterior area thereof.

The process of the present invention is particularly suitable for manufacturing exterior longitudinal grooves or comparable surface structures on preferably hollow workpieces. Normally, such workpieces are partially or completely closed on one side and are therefore also called housings.

The arrangement according to the present invention makes it advantageously possible to manufacture the workpiece from a blank with a smooth outer surface via a press, in which each press stroke molds a workpiece out of a blank. This permits the production of a particularly high run which allows an economical manufacturing.

During each press stroke, a rolling operation takes place during which the profile rolls press the desired outer profile into the surface area of the workpiece. The profile rolls are arranged in an opening of the bottom tool along the circumference of the workpiece to be machined and are held by a cage in a defined axial position with respect to one another. When the workpiece is pressed between the rolls by a top tool fastened on a plunger of the press, these rolls are supported radially to the outside on corresponding abutments provided on the wall of the opening. By way of their section engaging with the workpiece, the rolls deform the workpiece with the workpiece pressed through between the rolls taking along the rolls by half a working stroke into the opening. The profile rolls roll off on the abutments. The resulting radial forces are absorbed only by the abutments radially supporting the rolls but not by the cage which holds the profile rolls in a common plane.

Overall, the rotating movement of the rolls is caused by the fact that the workpiece as well as the corresponding abutment cause circumferential forces on each roll which act in the same circumferential direction and cause a rotation of the roll. The circumferential forces are transmitted by the static friction between the respective profile roll and the abutment as well as the workpiece which also rises with an increasing radial force, i.e. with an increasing workpiece deformation. The shafts or pins used for the bearing of the rolls are essentially free of forces. At most, a relatively low force acting in the moving (axial) direction of the workpiece is introduced into the profile rolls. Thus, large rolling forces can be generated in which the shafts of the rollers are completely relieved with respect to the radial force. The larger the roll diameter, the smaller the force which additionally has to be transmitted in the axial direction.

Because the abutments supporting the profile rolls are provided radially on the outside with respect to the opening provided in the bottom tool, a considerable surface is available for the transmission of force so that, if the profile rolls are sized correspondingly, considerably high radial forces can be absorbed. The axial force which must be transmitted from the cage to the profile rolls is comparatively low. Therefore, no significant frictional forces which counteract the rotation of the profile rolls is generated in corresponding bearings of the profile rolls.

The deformation operation is distributed along a press stroke section which is approximately twice as large as the length of the area to be deformed on the workpiece. As a result, the press stroke is virtually geared down and a good utilization of the force or work applied by the press is achieved. The uniform deformation of the workpiece which is distributed along the path of the press stroke excludes, in particular, force peaks as they may otherwise occur during the abrupt deformation of workpieces.

The bottom tool can be built up in a rotationally symmetrical manner, so that the individual profile rolls which generate the profile of the workpiece are distributed in a regular manner and with uniform angles with respect to one another along the workpiece circumference. As the result, and because of the resulting rotationally-symmetrical force distribution during a deformation operation, the individual grooves produced by the respective profile rollers are virtually the same with respect to one another. In particular, a step-free outer contour is achieved. Consequently, toothed belt pulleys can be produced which, even without any refinishing, provide a greater life of a toothed belt which later runs over these toothed belt pulleys. When the profile rollers are arranged correspondingly, however, non-circular workpieces can also be machined.

In an advantageous embodiment of the arrangement according to the present invention, the cage is connected with a transmission which drives the cage and therefore the profile rolls held thereby in the axial direction at half the slide speed as soon as the top tool was placed on the bottom tool. This transmission guides axial forces into the cage which, in addition to the circumferential forces applied to the profile rolls, permits their clean rolling-off on the abutments and the workpiece and prevents slipping.

The transmission device can be formed in a simple manner by a gear wheel group which is spaced away from the profile roll group and carried by the cage. These gear wheels engage with a toothing provided on the circumference of the bore. On their side which is interior with respect to the bore axis, the gear wheels engage with the toothing of a slide-type force transmission element which, during a working stroke, is driven by the workpiece and therefore finally by the top tool into the opening of the bottom tool. The thus-formed gear wheel transmission represents a restricted guidance for the profile rolls which, however, are guided into the axial direction only in a manner in which they run anyhow during the exact rolling-off. Other transmission devices, such as lever transmissions or the like can also be used.

The force transmission element is used for receiving the workpiece before its deformation. For this purpose, the element is provided with a corresponding receiving device on its front side facing the top tool. In the simplest case, this receiving device can be formed by an end face which, if required, is provided with centering devices. In order to keep the cage free of forces during a working stroke, the profile rolls are disposed on it preferably in a radially displaced manner.

In one particularly advantageous embodiment, the rolls have a diameter which is at least so large that the rolls carry out less than half a rotation during a press stroke. This has the result that the reaction forces occurring during the deformation of the workpiece predominantly are radial forces. In addition, it is therefore possible to divide the profile rolls so that a section facing the workpiece with the profile to be rolled and a radially exterior section pointing away from the workpiece are provided with a profile arranged for the best possible force transmission to the abutment device.

In their simplest form, the abutments can be constructed as a closed ring which converts the introduced radial forces into a pure tensile load. However, it is advantageous for individually adjustable supporting elements to be provided as abutments which can be adjusted radially and/or in their inclination. Thus, the diameter of the workpiece to be deformed can be adjusted within limits.

If the inclination is adjustable, it is possible to guide the profile rolls on paths inclined with respect to the longitudinal center axis of the opening. This has the result that the workpiece to be deformed is transformed into a truncated-cone shape. Thereby an expansion tendency after the completed deformation process, which can frequently be observed in housing-shaped workpieces closed on one side, can be counteracted.

Particularly in the case of an embodiment with two divided rolls, which have a working profile on their side facing the workpiece and have a supporting profile on their side facing the abutment, it has been found advantageous for devices to be provided on the bottom tool in order to hold the rolls in a fixed angular area with respect to their rotation during a stroke. This is particularly important for the return stroke in which the already deformed workpiece hardly exercises any significant radial force on the profile rolls. The above-mentioned devices rotate the profile rolls, however, back in their starting position so that the entire profiled area is available for the workpiece for the next working stroke.

The above-mentioned devices can be toothings which are provided on the abutment side of the rolls and which mesh with a toothed rack. The toothed rack is kept free of radial forces and preferably has a certain axial play. This arrangement ensures that the rotation of the profile rolls during a working stroke takes place independently of the engagement with the toothed rack. In order to achieve a defined starting position of the profile rolls during a return stroke of the press, the toothed rack can be prestressed by spring devices toward an undisplaced center position.

The deformation of the above-mentioned workpieces takes place by a process which is implemented when the above-mentioned arrangement is operated. The process results in workpieces with a good surface quality which permits the use of the workpieces, for example, as disk carriers for clutches or as toothed belt pulleys without any refinishing. In addition, a high run can be achieved thereby.

In the process according to the present invention, it was found to be advantageous to drive the cage containing the rolls in addition in the axial direction, for which a corresponding transmission is used. In this case, favorable deformation conditions are achieved when the product of the radial forces and the static friction coefficients for the profile rolls and the abutments or the workpiece is larger than the radial force exercised on the workpiece by the press. This can be achieved by the correspondingly large dimensioning of the profile roll diameters and results in low forces to be introduced by way of the profile roll shafts and the frictional forces therefore occurring there which brake the profile rolls.

BRIEF DESCRIPTION OF THE DRAWINGS

These and other objects, features and advantages of the present invention will become more readily apparent from the following detailed description thereof when taken in conjunction with the accompanying drawings.

DETAILED DESCRIPTION OF THE DRAWINGS

Figure 1:
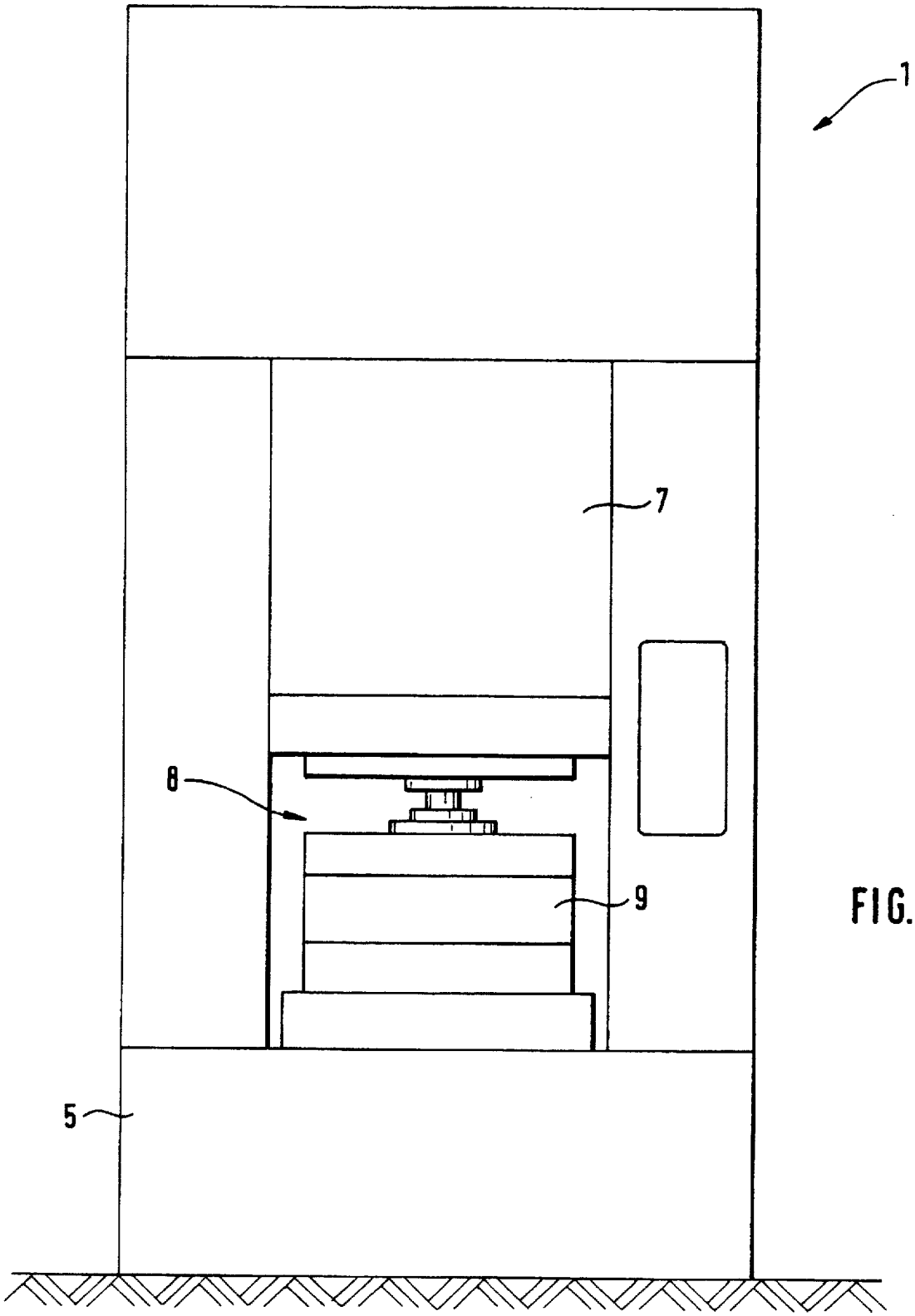
FIG. 1 is a schematic front elevational view of a press arrangement for manufacturing parallel profiles on rotationally symmetrical housings.
Figure 2A:
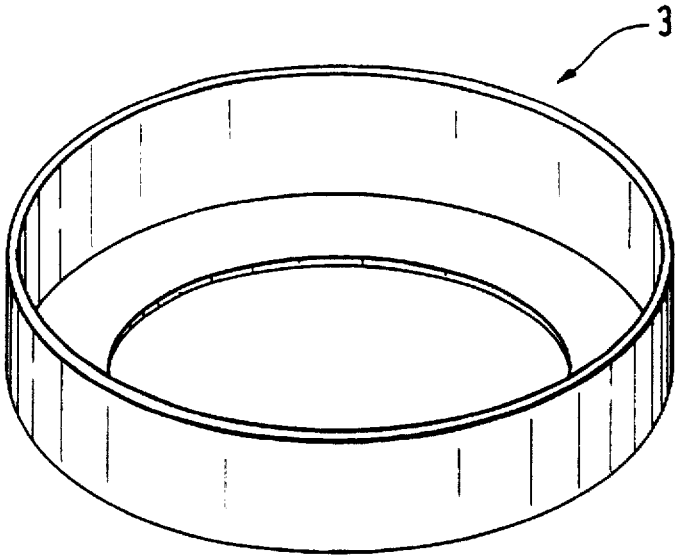
FIGS. 2*a* and 2*b* are perspective views of a hollow-cylindrical workpiece closed on one side, respectively, before and after its deformation in the press illustrated in FIG. 1.
Figure 2B:
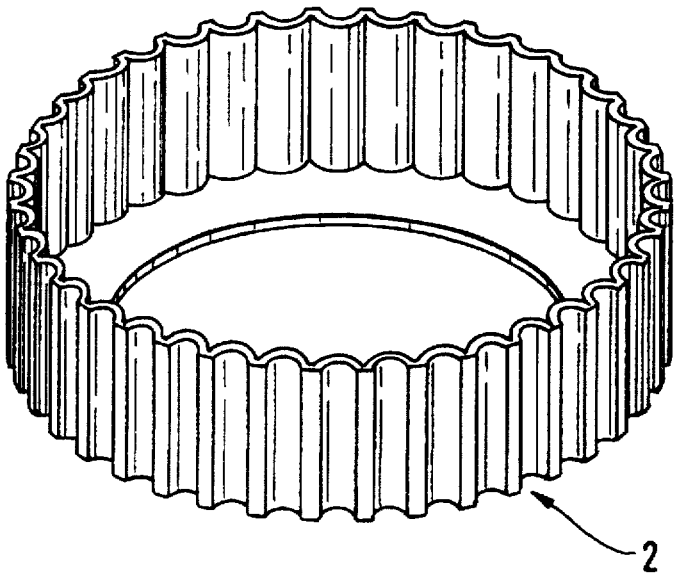

FIG. 1 shows a press designated generally by numeral 1 which is used for the manufacture of workpieces 2 illustrated in FIG. 2*b* from blanks 3 shown in FIG. 2*a*. The press has a stationarily arranged bedplate 5 above which, on a press stand 6, a slide 7 is disposed to be movable toward the bedplate 5 and away from it. In this case, the slide 7 is driven by a driving device, such as an eccentric transmission. In the press 1, a deforming tool 8 is provided for machining the blanks 3.

The deforming tool 8 includes a bottom tool 9 (illustrated in detail in FIGS. 3 to 5) which is arranged on the bedplate 5 and is situated opposite a top tool 11 connected with the slide 7. The bottom tool 9 and the top tool 11 are constructed such that during each working stroke the press deforms a blank 3 (FIG. 2*a*) into a workpiece 2 (FIG. 2*b*).

Figure 3:
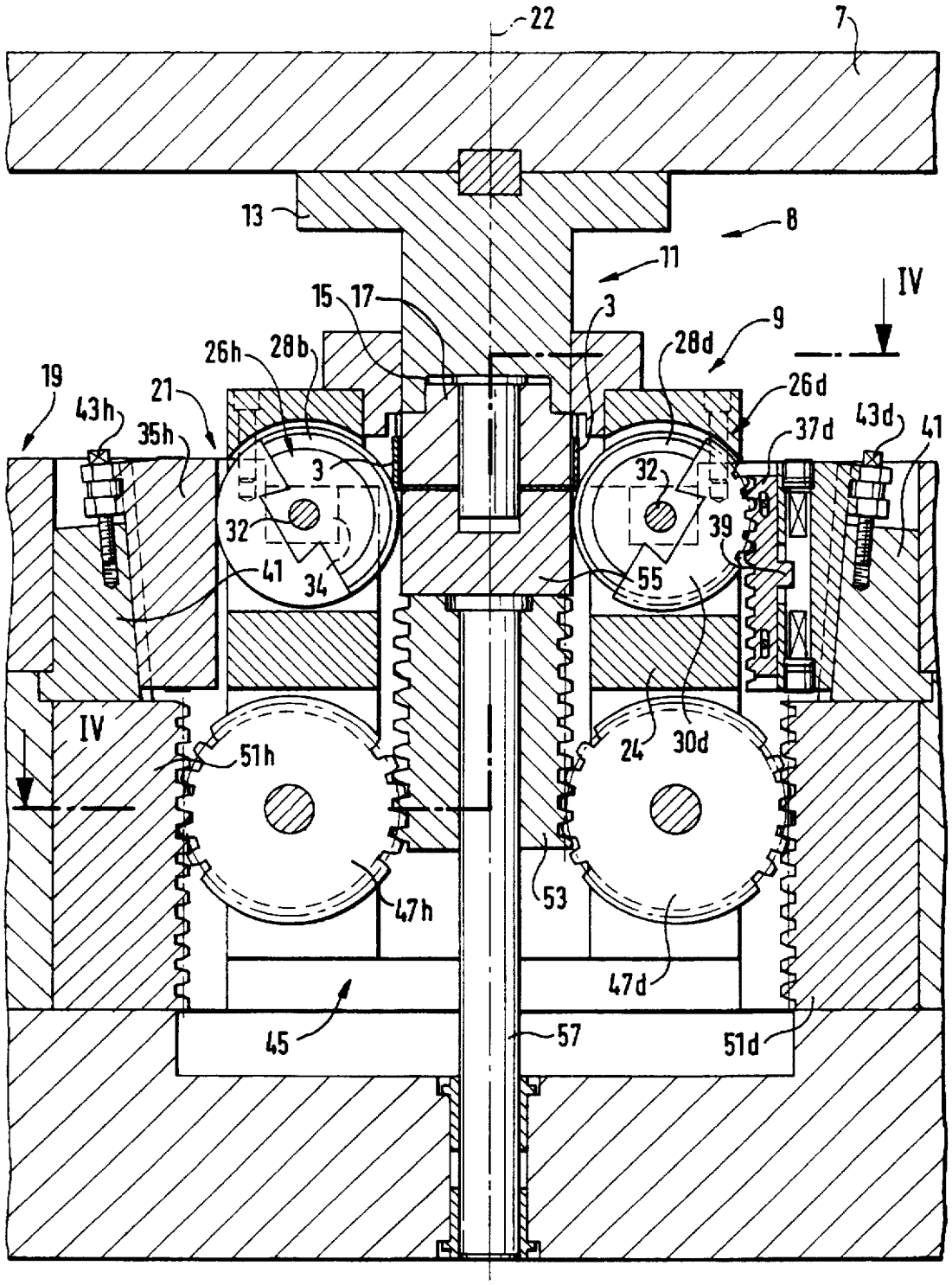
FIG. 3 is a longitudinal sectional view at the beginning of the working stroke of the arrangement for producing parallel profiles on rotationally symmetrical housings or workpieces according to FIG. 1.

The top tool 11 shown in FIG. 3 is also part of the deforming tool 8 has a relatively simple construction consisting essentially of the plunger 13 which is fastened to the slide 7 and which is arranged with a corresponding recess 15 for receiving a mold part or a male mold 17 for the blank 3. The male mold 17 is a body which is cylindrical in the area of the blank 3 and which is provided with an axial grooving on its exterior circumferential surface, which grooving corresponds to the inner contour of the molded workpiece illustrated in FIG. 2*b*.

Figure 4:
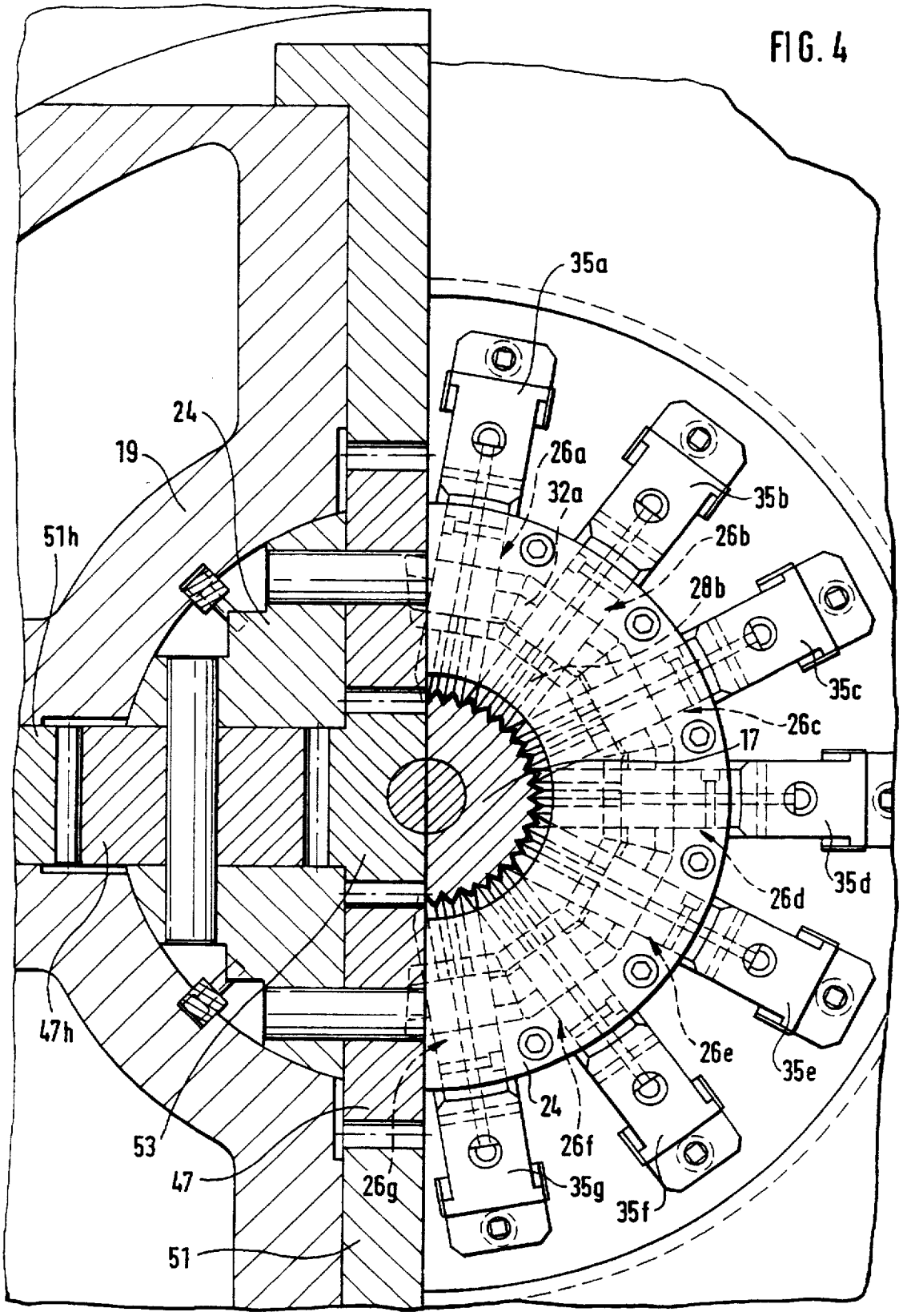
FIG. 4 is a top view of the arrangement along line IV—IV of FIG. 3.
Figure 5:
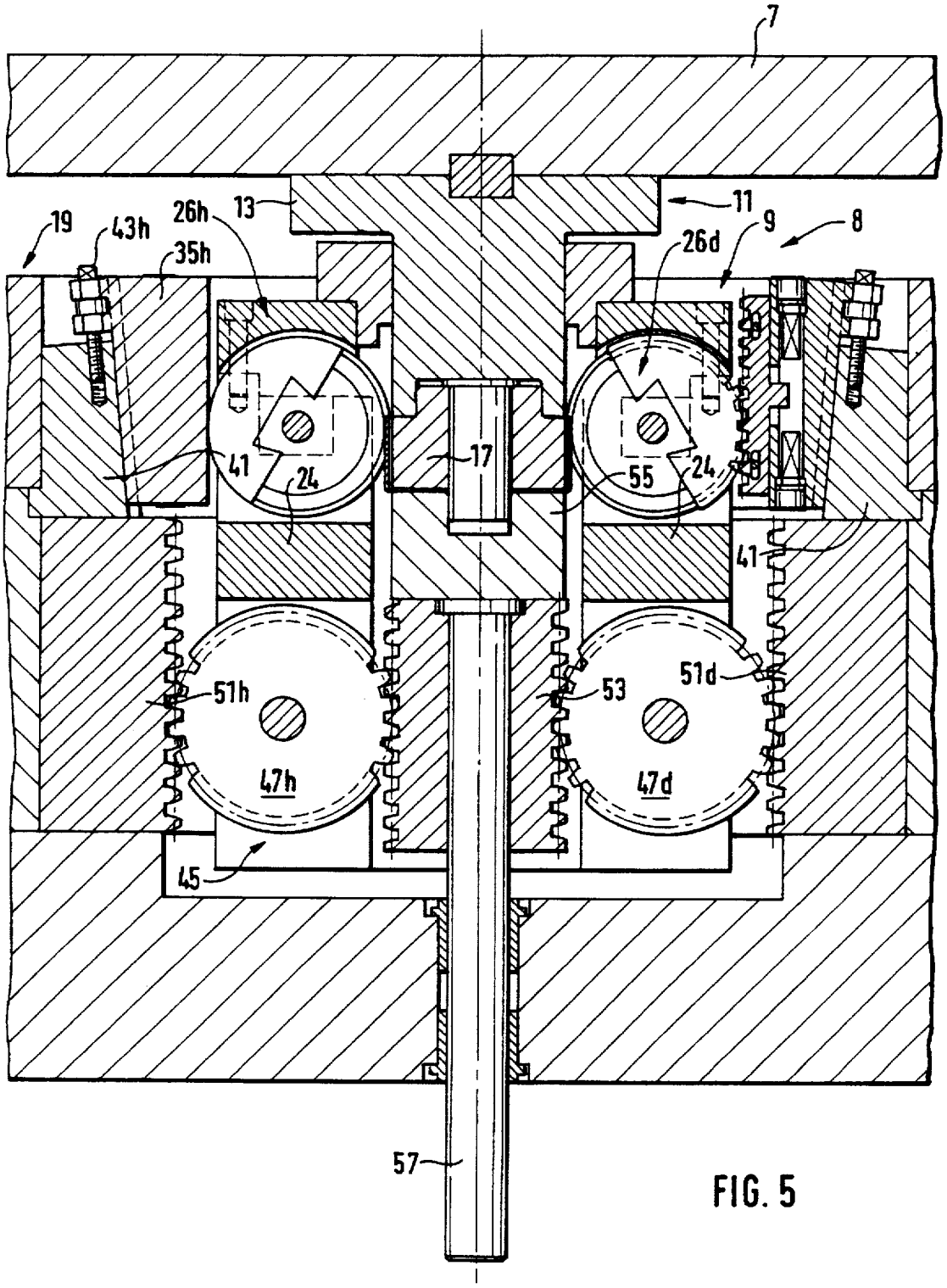
FIG. 5 is a partial schematic cross-sectional view of the arrangement according to FIG. 3 after the end of the working stroke.

The bottom tool 9 is a ring-shaped frame 19 which is shown, for example, in FIG. 4 and which bounds an opening 21 arranged coaxially with respect to a longitudinal center axis 22 defined by the rotationally symmetrical plunger 13. Concentric to the longitudinal center axis 22, a cage 24 is arranged essentially inside the opening 21 and has therein a set of separately rotatable profile rolls 26.

In addition, the profile rolls 26 are shown, for example, in FIG. 4 and, for a better differentiation in this description, are each provided with an individual letter index. Each profile roll 26 is divided in two parts, namely a profile section 28 engageable with the blank 3 or the workpiece 2 and having an approximately semicircular-disk shape in side view (FIG. 3) and a supporting section 30 which is situated on the opposite side and, for a better differentiation, is also provided with an individual letter index. The profile sections 28 are each provided in the circumferential direction with a groove profile which is complementary to the outer profile to be constructed on the workpiece. Each profile section 28 has a total of three circumferential ribs between which two grooves are situated which extend in the circumferential direction. In addition, the profile sections 28 are constructed such that, between two profile sections of two mutually adjacent profile rolls 26, a recess receives an outwardly projecting rib of the workpiece 2 to be molded.

The profile rolls 26 are rotatably disposed on pins 32 which are held by the cage 24. The pins 32 are disposed in guides 34 which can be displaced in the cage 24 radially toward the outside or inside relative to the longitudinal center axis 22. In the axial direction, however, the guides 34 are held essentially without play with respect to the cage 24.

Bearing elements 35 are arranged along the circumference of the opening 21 and are used as abutments. The elements 35 have a plane running surface on its side facing the profile rolls. Via their supporting sections 30, the profile rolls 26 rest against the running surfaces. In addition, the bearing elements 35 have a groove which penetrates the running surface and in which one toothed rack 37 respectively is housed. For a fuller illustration, the left side of FIG. 3 shows a section of the bearing element 35 past the toothed rack 37, and the right side shows a section which cuts the bearing element 35 in the area of the toothed rack 37*d*. Like the profile rolls 36, however, the bearing elements 35 also have an identical construction.

The toothed rack 37 is disposed with a larger longitudinal play and, on its back side, is provided with a projection 39 which engages with a spring device prestressed by screws so that the projection 39 is prestressed by the spring device toward a center position of the toothed rack 37. The two pins, which each hold the spring device on the end side, permit an adjustment of the center position.

As illustrated in FIG. 3, each bearing element 35 is chamfered on its back side and therefore has a wedge-shaped construction. The bearing element 35 is supported on a supporting ring 41 which has a sloped ring surface on its side facing the bearing element 35. The axial position of the bearing element 35 with respect to the supporting ring 41 is determined by way of an adjusting screws 43*d*, 43*h* which are supported on one end on the supporting ring 41 and on the other end on the respective bearing element 35. An adjusting of the adjusting screws 43*d*, 43*h* results in an adjustment of the radial position of the corresponding bearing element 35.

The axial position of the cage 24 is determined by a transmission which is arranged below the profile rolls 26. The transmission contains a group of gear wheels 47*d*, 47*h* (the individual letter index but used again for a clearer differentiation) which are spaced from the profile rolls 26, distributed in the circumferential direction and rotatably disposed on the cage 24. The gear wheels 47*d*, 47*h* mesh with stationarily disposed toothed racks 51 arranged in the frame 19. On their side facing the longitudinal center axis 22, the gear wheels 47 mesh with an outwardly toothed slide element 53 (or a slide element 53 having toothed racks) which is arranged concentrically with respect to the longitudinal center axis 22.

The slide element 53 forming an interior toothed rack changes on its side facing the top tool 11 into a female mold element 55 which is called a raiser and which is equipped for receiving the blank 3 or the workpiece 2 on its front side. For this purpose, the female mold element 55 is also equipped with centering devices, such as a bore and a pin which can be inserted therein.

The slide element 53 is connected with a so-called air pin 57 which is arranged coaxially to the longitudinal center axis 22 and, by way of a conventional pneumatic driving device or the like is arranged in the direction of the longitudinal center axis 22.

When the above-described arrangement 8 is opened up, i.e. when the plunger 7 is in its upper dead-center position, a blank 3 is first placed on the female mold element 55 and subsequently the male mold 17 is placed on the blank 3. During the operation, the male mold 17 and the plunger 13 are one piece and therefore fixedly connected. During the subsequent press stroke, the plunger 13 with the male mold 17 presses the blank 3 through between the profile rolls 26 into the position illustrated in FIG. 5.

At the start of moving stroke, the blank 3 does not yet rest against the profile rolls 26. By way of the slide element 53 and the transmission 45, however, the blank 3 takes along the cage 24 at half the slide speed so that the profile rolls 26 start to roll off on the bearing elements 35*a*, 35*b*, etc. In the course of its downward movement, the blank 3 comes in contact with the profile rolls which move downward at half the slide speed. The diameter of the profile rolls 26 is dimensioned such that they clamp the blank 3 therebetween and press axially extending grooves into its outer circumferential surface. The resulting forces are mainly radial forces which are supported on the bearing elements 35. Remaining axial forces are absorbed by the cage 24 and applied by the transmission 45. The axial forces are still considerably lower than the radial forces.

In the illustrated embodiment, the profile rolls 26 have such a diameter that, with a complete stroke of the plunger 13, they rotate only by 90°, but at least less than 180°. In the course of this rotation, they move into the position illustrated in FIG. 5, whereby the profile section 28 meshes with the blank 3 bringing the desired grooving into the outer circumferential surface of the blank 3 so that the desired configuration of the workpiece 2 is obtained.

After the deformation has taken place, the top tool 11 travels back into its upper dead-center position, after which the air pin 57 is operated to raise the slide element 53 and the female mold element 55 again. The cage 24 thereby moves back into its upper dead-center position. The workpiece 3 is pulled out of the bottom tool 9, to now move almost free of forces and only with a slight radial force along the profile rolls 26. These rolls are rotated back into their desired starting position by the toothed racks 37.

In the above-described embodiment, the bearing elements 35 are held to be only axially adjustable and are therefore, because of the wedge effect of the supporting ring 41, radially adjustable. The moving paths for the supporting sections 30 of the profile rolls 26 defined by the bearing elements 35 are axially aligned. It is also within the scope of the present invention to configure the running surfaces with a slight inclination with respect to the longitudinal center axis 22.

Figure 6:
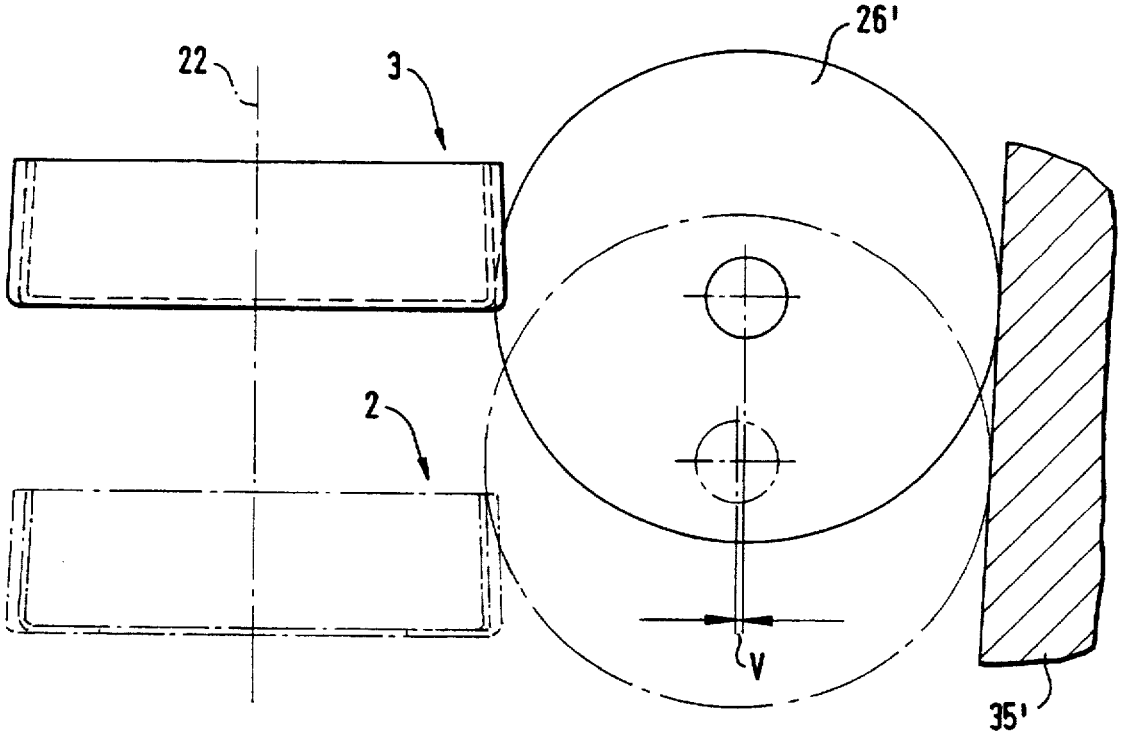
FIG. 6 is a schematic representation of the kinematic conditions when the arrangement illustrated in FIG. 3 is adjusted such that corresponding profile rolls which engage with the workpiece are guided in an inclined manner relative to the moving direction of the workpiece.

In addition, it is possible to provide an adjusting device in order to be able to adjust this inclination. Such an embodiment is schematically indicated in FIG. 6, showing the profile roll 26' and the bearing element 35'. The radial displacement V of the profile rolls 26' which occurs during the working stroke of the arrangement 8 results in a conical deformation of the workpiece 2. This is desirable particularly in those cases in which a springy expansion of the workpiece 2 is to be expected after the removal from the arrangement 8. When the conicity is adjusted correctly, the result is a workpiece 2 with a cylindrical grooved outer contour.

For shaping longitudinal grooves or comparable longitudinal structures into round housings or housings which are otherwise shaped in a regular manner with respect to a longitudinal axis, a press with a deforming tool 8 is used as a basis. The top tool 11 of this deforming tool 8 presses a workpiece 2 through a corresponding roll arrangement of a bottom tool 9. The bottom tool 9 has an opening 21 which is coaxial with respect to the top tool 11 and in which a cage 24 is disposed in an axially displaceable manner. The cage 24 is provided with a group of rolls. The rolls are rotatably disposed in the cage 24 and are supported on radially exterior abutments 35 which are stationarily held in the bottom tool 9. The rolls are constructed as profile rolls 26 and shape the desired longitudinal structures into the workpiece 3 when this workpiece 3 is moved through the profile rolls 26. The resulting radial reaction forces are absorbed exclusively by the abutments 35 but not by the cage 24. For supporting the longitudinal movement of the cage 24, a transmission 45 can be provided and formed, for example, by gear wheels 47 which are rotatably disposed on the cage 24, and are supported radially on the outside on stationary toothed racks Si and radially on the inside on a slide 53 which is provided with toothed racks and is actuated by the workpiece 3. This device permits a high product quality and a high production run at lost cost.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A press for manufacturing profiles, including parallel profiles on rotationally symmetrical housings, comprising a top tool fastenable on a slide of the press movable against a tool receiving device and engageable with and disengageable from a workpiece, a bottom tool stationarily disposable with respect to the slide and having an opening into which the top tool is movable and with an axis coinciding with a moving direction of the top tool, a set of profile rolls arranged in the opening of the bottom tool and having outer circumferential surfaces in contact with abutments which bound the opening and support the profile rolls radially outwardly, the profile rolls being arranged with axes of rotation thereof in a circumferential direction of the opening, and a cage arranged in the opening and which the profile rolls are held in the circumferential direction and movable in the axial direction of the opening such that the profile rolls are caged to one another with respect to the axial direction of the opening wherein the cage is positively connectable with a transmission for driving the cage in the axial direction at a speed which is half a speed of the top tool.

2. The arrangement according to claim 1, wherein the transmission contains a set of form-fitting transmission devices arranged in the opening, connected on an exterior side thereof with the wall of the opening and rotatably disposed on the cage with axes of rotation thereof oriented in the circumferential direction of the opening, and on a radially interior side thereof, the transmission devices are connectable with a force transmitting element arranged to be movably disposed in the axial direction of the opening.

3. The arrangement according to claim 1, wherein the profile rolls are radially displacably disposed on the cage.

4. The arrangement according to claim 1, wherein the profile rolls have a diameter sized so that, during a press stroke, less than half a rotation is carried out.

5. The arrangement according to claim 1, wherein the profile rolls are divided into two parts and, on a side thereof situated radially on an inside with respect to the opening of the bottom tool, have a profile which is complementary with respect to the profile to be formed on the workpiece and, on a radially exterior side thereof, have a profile which permits a line contact with the abutments.

6. The arrangement according to claim 1, wherein the abutments are radially adjustable.

7. The arrangement according to claim 1, wherein the abutments are configured to be adjustable in an inclination thereof with respect to the axial direction of the opening.

8. The arrangement according to claim 1, wherein devices are provided on the bottom tool for holding the profile rolls in a fixed angular area with respect to a rotation thereof during a stroke of the arrangement.

9. The arrangement according to claim 2, wherein the form-fitting transmission devices are gear wheels which are in a meshing engagement with a toothing which is arranged on the end of the opening disposed away from the top tool.

10. The arrangement according to claim 2, wherein the force transmitting element is configured on a front side thereof facing the top tool to receive the workpiece.

11. The arrangement according to claim 9, wherein on an exterior side thereof, the force transmitting element has a toothing which is in a meshing engagement with the gear wheels.

12. The arrangement according to claim 8, wherein the profile rolls are provided on a side thereof situated radially on the outside with respect to the opening of the bottom tool with a toothing in meshing engagement with associated toothed racks.

13. The arrangement according to claim 12, wherein the toothed racks are configured to be axially displaceable.

14. The arrangement according to claim 13, wherein spring devices are provided to prestress the toothed racks toward an undisplaced center position.

15. A process for manufacturing profiles, including parallel profiles on rotationally symmetrical housings, comprising the steps of introducing a workpiece to be deformed in a restrictedly operated manner into an opening of a tool in which profile rolls are held by a cage, the profile rolls being arranged to roll off in a moving direction of the workpiece, connecting the cage with a transmission for driving the cage in an axial direction at a speed which is half a speed of the tool engaging the workpiece with circumferential sections of the profile rolls facing the workpiece, the profile rolls being supported on their respective diametrically opposite circumferential areas within the opening, and pressing the workpiece farther into the opening, the profile rolls on one side rolling off on the workpiece and on another side on corresponding abutments and deforming the workpiece in an exterior area thereof.

16. The process according to claim 15, wherein a product of the radial forces to act upon the rolls and to be absorbed by the corresponding abutments and of coefficients of friction for material pairing of the roll and of the abutments is larger than the axial force required for inserting the workpiece.

* * * * *